United States Patent [19]

Kiikka et al.

[11] 4,341,751

[45] Jul. 27, 1982

[54] REDUCING CARBOXY REACTIVITY IN COKE

[75] Inventors: Oliver A. Kiikka, Willoughby, Ohio; Keith A. Connors, Moundsville, W. Va.

[73] Assignee: The Standard Oil Company, Cleveland, Ohio

[21] Appl. No.: 290,039

[22] Filed: Aug. 5, 1981

Related U.S. Application Data

[63] Continuation of Ser. No. 221,184, Dec. 30, 1980, abandoned.

[51] Int. Cl.[3] ..... C01B 31/02

[52] U.S. Cl. ..... 423/461; 201/17; 423/265; 423/275; 423/448; 423/460

[58] Field of Search ..... 423/461, 448, 449, 460, 423/265, 274, 275; 201/17, 39

[56] References Cited

U.S. PATENT DOCUMENTS

| | | | |
|---|---|---|---|
| 3,284,317 | 11/1966 | Jahnig et al. | 201/17 |
| 3,320,150 | 5/1967 | Metrailer | 204/294 |
| 3,454,363 | 7/1969 | Rieve | 423/461 |
| 3,812,017 | 5/1974 | Santangelo et al. | 201/17 |

FOREIGN PATENT DOCUMENTS

| | | | |
|---|---|---|---|
| 1096716 | 3/1980 | Canada . | |
| 453072 | 9/1936 | United Kingdom | 423/461 |
| 2023557 | 1/1980 | United Kingdom . | |

OTHER PUBLICATIONS

Chemical Abstract 92:118539k, "Carbon Electrode Coated with Antioxidants for Aluminum Electrolysis", (1980).

A. Limonchik, "Increasing the Oxidation Resistance of Carbonaceous Bodies", pp. 459–470, (reprint of Feb. 22–26, 1981 Conference Proceedings from Metallurgical Society of AIME) published as Light Metals 1981, ed. Gordon M. Bell.

Chemical Abstracts, vol. 72, 134755v, 1970.

*Primary Examiner*—Edward J. Meros

*Attorney, Agent, or Firm*—W. A. Heidrich; Herbert D. Knudsen; Larry W. Evans

[57] ABSTRACT

Carbon dioxide and air reactivity reactions occurring during carbon electrode use, can be minimized by the use of quench water treated with phosphoric acid following calcination of the coke used to make the electrode.

8 Claims, No Drawings

REDUCING CARBOXY REACTIVITY IN COKE

This is a continuation of application Ser. No. 221,184 filed Dec. 30, 1980, now abandoned.

BACKGROUND OF THE INVENTION

The present invention is concerned with the carbon dioxide and air reactivity reaction occurring during carbon electrode use. As noted in U.S. Pat. No. 4,130,475, coke formed from petroleum refinery streams is classified as No. 1 or premium coke, and No. 2 or regular coke. Premium coke differs from regular coke by its predominant metallic, crystalline appearance and a low linear coefficient of thermal expansion (CTE).

Both types of coke are used for the manufacture of carbon electrodes utilized in industry. The steel industry uses electrodes formed from premium coke in electric arc furnaces, while the aluminum industry uses electrodes formed from regular coke to produce aluminum. The description of such use in making aluminum can be found in Kirk-Othmer *Encyclopedia of Chemical Technology,* Vol. 1, page 941.

Prior to the formation of electrodes, the refinery petroleum coke must first be calcined. Calcination usually occurs with temperatures in excess of 2200° F., preferably above 2500° F. The calcination densifies the coke and removes volatile matter while changing the carbon to hydrogen ratio.

The coke exiting the calciner at these high temperatures must then be cooled. This is typically accomplished in a cooler wherein water is sprayed onto the coke. The water by evaporation cools the coke to a suitable temperature. This calcined, cooled coke is then formed into electrodes.

As noted in the Kirk-Othmer reference, aluminum is formed by the electrolysis of alumina wherein the oxygen from the alumina combines with the carbon of the electrode to form carbon dioxide. A second and unwanted reaction occurs when the carbon dioxide again reacts with the carbon to form carbon monoxide. While 0.45 lbs. per lb. of aluminum is utilized for the electrolysis, 0.05 lbs. of carbon per lb. of aluminum is lost in forming carbon monoxide. The ability of a carbon electrode to react with $CO_2$ to form carbon monoxide is known as the carboxy reactivity.

In the steel industry, electrodes are used in arc furnaces for melting of steel. A similar unwanted reaction occurs with air reacting with the carbon to form carbon oxides. Typically, 15–25% of the carbon is lost to this air reactivity reaction.

U.S. Pat. No. 3,320,150 notes that high reactivity can sometimes be due to the type of binder material or binder coke that is used and thus suggests a decrease in reactivity by utilizing a fine coke with a reactivity lower than the binder coke. U.S. Pat. No. 3,454,363 discloses the removal of metal contaminants from coke to lower reactivity. It is noted that the presence of cations is detrimental to some of the potential applications of coke, and thus the coke is contacted with a cation exchange resin to remove cations and thus lower reactivity. Ser. No. 107,988 filed Dec. 28, 1979, now abandoned, discloses a method of reducing coke reactivity by treatment of the quench water during the coking stage to remove such cations prior to any deposit on the coke.

It has been found that if the water used to quench calcined coke is treated with phosphoric acid, a lower reactivity and thus a better product can be obtained.

SUMMARY OF THE INVENTION

The invention is a process for reducing the reactivity of calcined coke by the steps of:

(a) calcining the coke to densify and remove volatiles therefrom; and (b) cooling said calcined coke by contacting said coke with water treated with a member selected from the group consisting of monomeric, dimeric, or polyphosphoric acids and salts thereof.

The calcining of coke is known to those in the art and is typically accomplished in a rotary calciner. Calcining temperatures are usually in excess of 2200° F., with coke exiting the calciner at temperatures as high as 2700° F.

The coke is then cooled in a cooler as described previously, by directly contacting the coke with water. It is desired to cool the coke to a temperature of around 300° F., and thus air cooling is uneconomical. Typically, it takes appproximately 1 lb. of water per lb. of coke during this cooling process. Normally well water has been utilized as a source for this cooling stage.

The treatment of water is also well known in the art. A good description of the type of treatment available can be found in Kirk-Othmer *Encyclopedia of Chemical Technology,* Vol. 22, page 73 and *Power Magazine,* June 1973, page S-1.

As described in the *Power* article, water normally contains a variety of dissolved compounds, with each compound breaking into its respective charged part or "ion" when dissolved. Positively charged ions are called cations while the negatively charged ions are called anions.

As described in the Background, it has been proposed that water used to cool calcined coke be treated with an ion exchange resin to remove cations which have been shown to effect reactivity. However, such treatment of large quantities of water necessary to cool the calcined coke entails great expense. The water cannot be recycled due to evaporation. It has been discovered that the addition of phosphates such as monomeric, dimeric or polyphosphoric acid and salts thereof to the cooling water in parts per million amounts have a dramatic effect on the reactivity of the coke.

Some species of phosphates have been used in water treatment systems to prevent corrosion and deposits in distribution lines. These have included polyphosphates such as sodium hexametaphosphate or sodium tripolyphosphate in less than stoichiometric amounts. The addition of polyphosphates inhibits calcium carbonate deposition by sequestration. However, due to the fact that evaporation occurs when utilizing water as a cooling agent to calcined coke, the use of these polyphosphates would not be expected to have any effect on the reactivity of the coke.

Surpisingly, it has been found that the above noted phosphates, preferably orthophosphoric acid, has a dramatic effect on reducing the reactivity of the calcined coke when used in amounts of 1,000 ppm or less.

For purposes of description, the invention will be described with respect to orthophosphoric acid.

The amount of acid to be added to the water used for cooling depends upon the type of water being utilized and the degree of reduction in reactivity preferred. For most waters, including well water, it has been found that amounts between 5–1,000 ppm are sufficient. While reactivity does decrease in the use of amounts and the 20–80 ppm range, a preferred range may be stated between 100–600 ppm.

The phosphoric acid may be injected into the water stream at any point prior to the water contacting the hot calcined coke. Injection systems for addition of small amounts of additives into aqueous mediums is well known in the art and need not be described in detail.

The following examples show the effect of using cooling water treated with phosphoric acid and its effect on $CO_2$ Reactivity ($RCO_2$). This value is determined by sampling the coke to be tested and drying it at 120° C. to a constant weight. This weight was recorded as the initial sample weight, or "WI". The sample was then inserted into a furnace operating at 1,000° C. $CO_2$ was flowed over the sample at approximately 50 normal liters per hours for two hours. The sample was then cooled in a desiccator, with the final weight being recorded as "WF". $CO_2$ Reactivity was then calculated as follows:

$$CO_2 \text{ Reactivity} = (WI\text{-}WF)/WI + 100$$

Comparative Example A

Calcined coke at a temperature of approximately 2600° F. was cooled by spraying untreated water onto the coke. The $CO_2$ reactivity is noted in Table I.

EXAMPLES 1–2

To show the effect of phosphoric acid addition, phosphoric acid was first diluted with water prior to injection. A metering pump was then used to inject the mixture into cooling water lines going to the spray heads for cooling the calcined coke. Examples 1 and 2 show the effects of the addition of low quantities of phosphoric acid to the $CO_2$ reactivity values.

TABLE I

| Effect of Low ppm Addition of $H_3PO_4$ to Cooling Water | | |
|---|---|---|
| Example | $H_3PO_4$ Conc. PPM | % $RCO_2$ |
| Comp. Ex. A | 0 | 21.7 |
| 1 | 30 | 17.1 |

TABLE I-continued

| Effect of Low ppm Addition of $H_3PO_4$ to Cooling Water | | |
|---|---|---|
| Example | $H_3PO_4$ Conc. PPM | % $RCO_2$ |
| 2 | 49 | 15.7 |

In the same manner as the above examples, Table II below shows the effect of higher rates of addition of phosphoric acid to the cooling water.

TABLE II

| Effect of High ppm Addition of $H_3PO_4$ to Cooling Water | | |
|---|---|---|
| Example | $H_3PO_4$ Conc. PPM | % $RCO_2$ |
| Comp. Ex. B | 0 | 23.6 |
| 3 | 100 ppm | 14.5 |
| 4 | 200 ppm | 11.0 |
| 5 | 400 ppm | 5.6 |

As can be seen in the above examples, substantial reduction in the $CO_2$ reactivity values can be obtained when utilizing phosphoric acid in the water used to cool the calcined coke.

We claim:

1. A process for reducing the reactivity of calcined coke by the steps of:

(a) calcining the coke to densify and remove volatiles therefrom; and (b) cooling said calcined coke by contacting said coke with water treated with a member selected from the group consisting of monomeric, dimeric, or polyphosphate acids and salts thereof.

2. The process of claim 1 wherein the water is treated with monomeric phosphoric acid.

3. The process of claim 1 wherein the water is treated with dimeric phosphoric acid.

4. The process of claim 1 wherein the water is treated with polyphosphoric acid.

5. The process of claim 2 wherein the water is treated with orthophosphoric acid.

6. The process of claim 5 wherein the amount of orthophosphoric acid added to the water is between 5–1000 ppm.

7. The process of claim 6 wherein the amount of orthophosphoric acid added to the water is an amount between 100–600 ppm.

8. The process of claim 1 wherein the calcining of the coke is at a temperature greater than 2200° F.

* * * * *